United States Patent [19]

Benson

[11] 4,249,306

[45] Feb. 10, 1981

[54] ERASING KNIFE

[76] Inventor: Bengt A. Benson, Styckjunkargatan 5, 114 34 Stockholm, Sweden

[21] Appl. No.: 73,984

[22] Filed: Sep. 10, 1979

[51] Int. Cl.[3] ..... B26B 1/00

[52] U.S. Cl. ..... 30/169; 30/349

[58] Field of Search ..... 30/169, 40.1, 349, 165

[56] References Cited

U.S. PATENT DOCUMENTS

| | | | |
|---|---|---|---|
| 1,629,775 | 5/1927 | Collander | 30/169 X |
| 2,051,199 | 8/1936 | Christianson | 30/40.1 |
| 2,054,104 | 9/1936 | Smith | 30/165 |
| 2,057,984 | 10/1936 | Staples | 30/169 |
| 2,563,634 | 8/1951 | Arey | 30/40.1 |

FOREIGN PATENT DOCUMENTS

| | | | |
|---|---|---|---|
| 372184 | 5/1932 | United Kingdom | 30/40.1 |
| 372642 | 5/1932 | United Kingdom | 30/40.1 |

*Primary Examiner*—Jimmy C. Peters

*Attorney, Agent, or Firm*—Blanchard, Flynn, Thiel, Boutell & Tanis

[57] ABSTRACT

According to the disclosure there is provided a continuously sharp erasing knife by a thin, hardened steel strip honed along at least one edge being given a special form with the aid of a dispenser, allowing the honed edge to be applied to a substructure for erasure in an effective cutting or scraping attitude. The strip is provided with weak zones and can be successively advanced from the dispenser so that end pieces which have become blunt can be broken off. At the same time, the dispenser forms a storage container for these broken-off pieces.

10 Claims, 17 Drawing Figures

ERASING KNIFE

The present invention relates to erasing knives, and particularly such a knife whose cutting or scraping edge can be continuously renewed.

Erasing knives are available in many different designs and are generally used by draughtsmen, typists and many others, both in connection with their work and in private. The demand on edge sharpness is very high, and a disadvantage is that an erasing knife must be often sharpened or honed to retain its effectiveness. Such an operation is troublesome and time-consuming, and it could be claimed that amongst erasing knives in use, the majority leave much to be desired with regard to keenness. In actual fact, many consider that the best "erasing knife" consists of a razor blade of the older type, which has been broken in two, each of the halves then being used with excellent results for erasing purposes; unfortunately for a rather short time since the edge is quickly blunted.

Knives with shanks or handles are also available for scoring or cutting sheet material made from carton, plastics and the like, these knives having loose blades which can be thrown away and replaced when they have become blunt, or the shaft can accommodate a longer blade, the cutting edge of which is renewed progressively by the blade end being broken off at a weakened zone so that a sharp edge is always available for cutting. However, erasing knives cannot be produced according to this principle, since the edges in these known knives always form some rather large angle to the material cut, whereas for the erasing knife it is characteristic that the cutting or scraping edge must be brought to bear practically flat, i.e. in the same plane, with respect to the surface on which erasing is to take place, at least for a short length of the edge. Up to now, no erasing knife with an exchangeable blade or one one that can be broken off, and which meets this general "erasing condition", has yet been proposed.

Thus the object of the invention is to provide an erasing knife meeting the said condition, the active scraping edge of which can be renewed continuously without grinding or honing, so that the knife retains its full effectiveness during the whole of its active life.

Figure 1A:
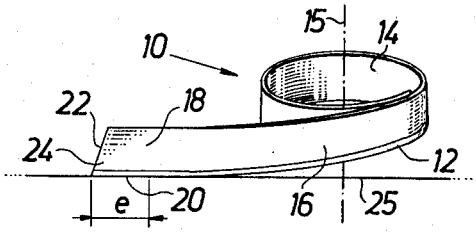
Figure 1B:
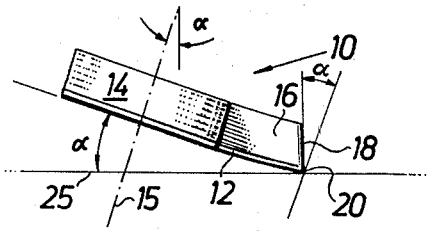
Figure 1C:
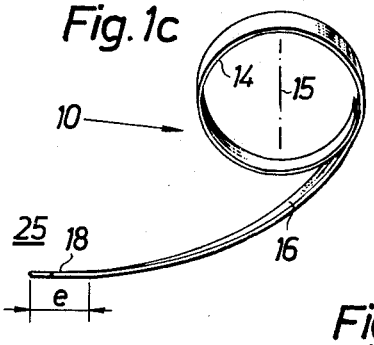
Figure 2:
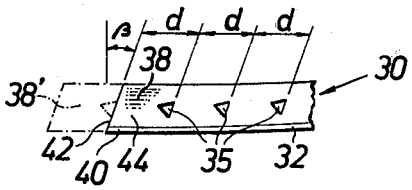
Figure 3:
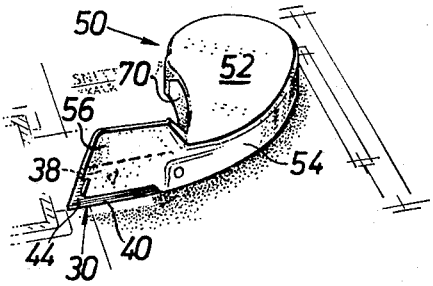
Figure 4:
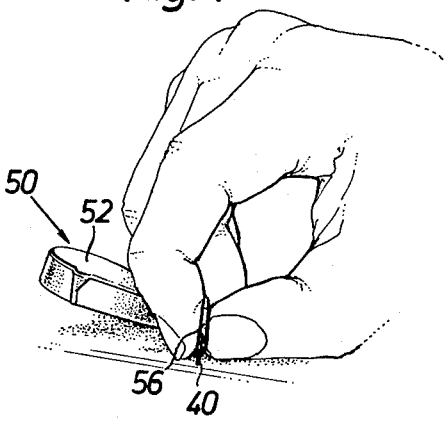
Figure 5:
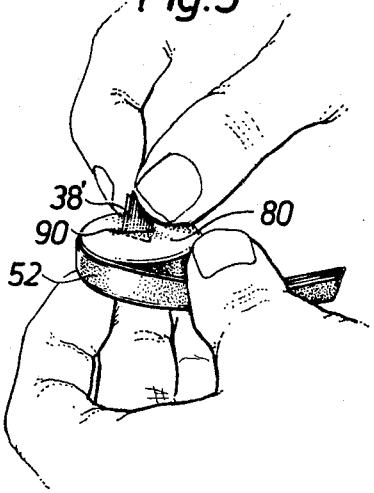
Figures 6A, 6B, 6C, 6D, 7A, 7B, 7C, 8, 9, 10:
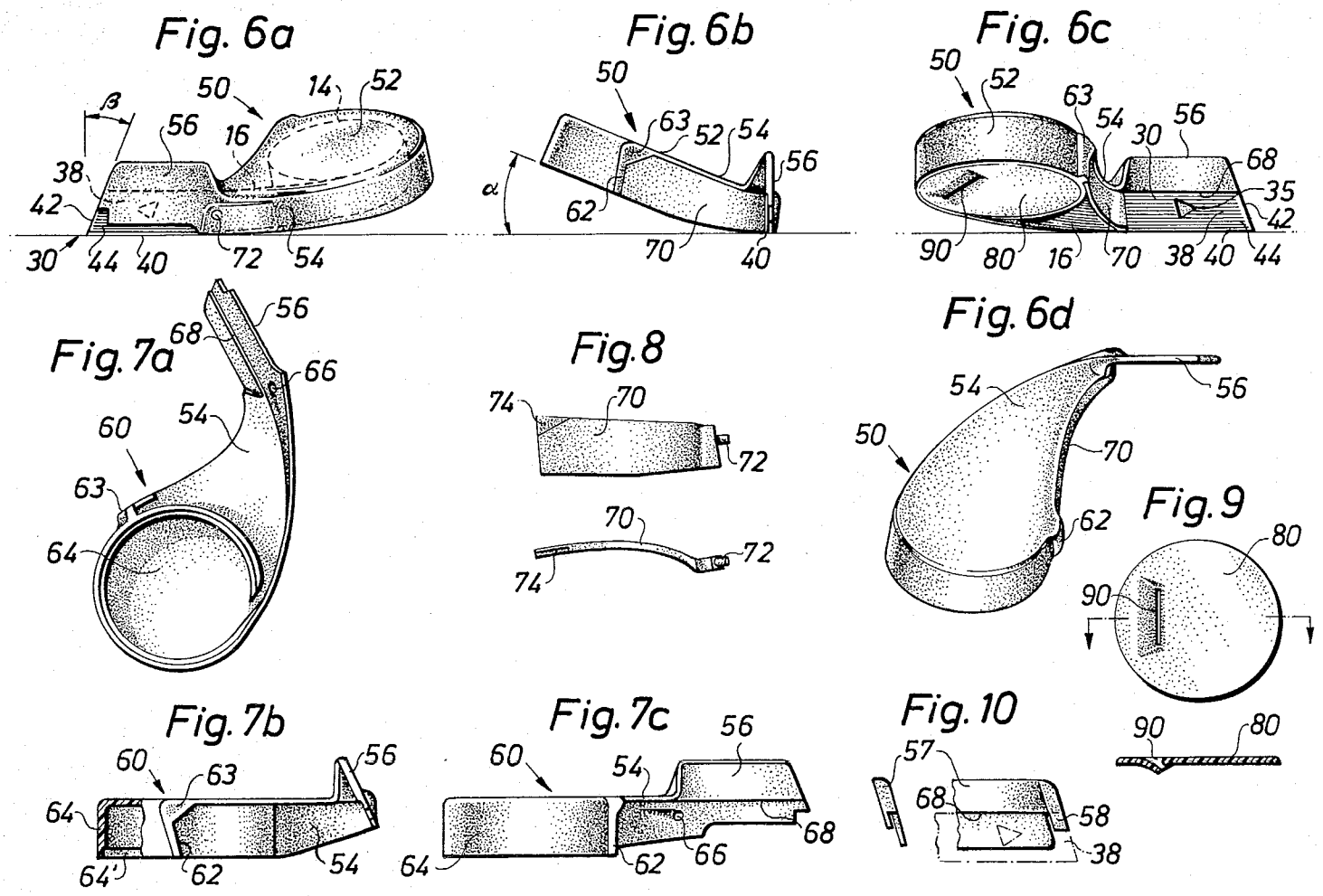

An embodiment of the invention will now be described for the purpose of exemplification while referring to the appended drawings, on which FIGS. 1*a*, 1*b* and 1*c* are schematic views illustrating the basic principle of the invention, while FIG. 2 shows an end part of a steel strip incorporated in the exemplifying erasing knife according to the invention. FIG. 3 is a perspective view of the whole of this knife in a position of rest, and FIG. 4 illustrates how the knife is used during an erasing operation. FIG. 5 shows how a cutting element broken off from the knife is safely disposed of. FIGS. 6*a*, 6*b*, 6*c* and 6*d* show projections in different planes of the knife in its entirety, the knife being disposed in its working attitude. FIGS. 7*a*, 7*b* and 7*c* are a series of views of a housing incorporated in the knife, while FIG. 8 shows in plan and side view a fin coacting with the housing. FIG. 9 shows a plan view and section a bottom plate or lid for coaction with the housing according to FIG. 7. Finally, FIG. 10 shows two detailed views of a modified portion of the housing according to FIG. 7.

In its different views a–c, FIG. 1 illustrates the inventive concept while referring to a concrete example. A strip 10 of hardened carbon steel, 0.10–0.12 mm thick and about 8 mm wide, has one edge 12 ground sharp. With regard to thickness, steel quality and edge, the strip 10 generally corresponds to the conventional, "classical" razor blade, which is per se very suitable for erasing purposes, as pointed out in the introduction. The strip 10 is wound up into a coil 14, which is substantially cylindrical and has a diameter of 28–30 mm, only one turn of this coil being shown in FIG. 1, for the sake of simplicity. From the coil 14 the strip goes in an arcuate tongue 16 to a generally straight and flat end piece 18 having a length e, this end piece being terminated by a sloping, broken-off edge 22. The sharp edge of the strip forms a straight, active edge portion 20 along the end piece 18, this portion thus similarly having the length e.

The different views of FIG. 1 illustrate how the strip 10 according to the invention is orientated in space to allow the straight end piece 18 to be applied perpendicular to a flat substructure 25, at the same time as the edge 20 of this piece is brought to engage against the substructure and in the plane thereof. The strip thus extends from the part 18 in the form of the tongue 16 to the coil 14, while following a path obliquely upwards-backwards to merge with the coil, the geometrical axis 15 of which is thus inclined to the substructure 25, see FIG. 1*b*, and forms a certain, acute angle $\alpha$ (in the order of magnitude 20°) with a normal to the substructure and thus also with the plane of the end piece 18. The coil will thus be in a raised position in relation to the end piece and thereby form approximately the same angle $\alpha$ to the substructure 25; the different views 1*a*, 1*b* and 1*c* actually being somewhat over-simplified, since in reality the tensions occurring in the strip tend to tip the coil 14 somewhat sideways in the given orientation, namely so that FIG. 1*b* should show a glimpse of the underside of the coil, and FIG. 1*a* the coil with its axis 15 sloping somewhat to the right etc. This has, however, no importance for the final result which is that the end piece 18 is freely accessible to a finger grip and can be brought to scrape with its edge 20 against the substructure 25 in a way best adapted to effective erasure. The erasing operation is hereby limited to just this end piece 18 and its active edge 20, primarily to the area immediately adjacent the free end 22 of the strip which, as mentioned, is broken off at an angle so that the strip forms a tip 24 adjacent the substructure. When the active portion 20 has become blunt, the strip can be pulled forward a distance from the coil 14 and broken off, so that a new keen edge portion is obtained at the end of the strip for continued erasure, with the geometrical relationships described above reinstated. New, active edge portions can be advanced as long as the coil 14 lasts.

The length e of the flat end piece 18 is 10 to 15 mm in the exemplified case, but it is particularly emphazised that e can also be selected very short in certain cases, e.g. only 2 to 3 mm; for effective erasure it is only essential that there is an active "straight" portion of the edge adjacent the tip 24.

FIG. 2 shows the end of a strip 30 having an edge 32 (with an active portion 40 along an end piece 38 of the strip) and which otherwise corresponds to the strip 10 except that it is provided with perforations or holes 35, arranged at a pitch d somewhat exceeding the width of the strip; in this case d is about 10 mm. The holes can suitably have the shape of equilateral triangles with the sides sloping as shown in FIG. 2, the holes forming weak zones so that the used end pieces 38' of the strip can be easily broken off. With the triangular sides of the holes 35 oriented as shown in FIG. 2, the broken-off strip end 42 is given a suitable inclination $\beta$ at the tip 44, to a normal to the substructure, this angle preferably having the order of magnitude of 15° . For a strip with the dimensions set forth, the inscribed circle of the triangular holes 35 has a diameter of about 2.5 mm. It is pointed out, however, that the holes can naturally be given other shapes, e.g. circular, semi-circular or elongated (rectangle, parallelogram) etc.

FIG. 1 illustrates the inventive concept, and a steel strip with one long edge ground sharp, coiled up with an outwardly extended tongue and with the characteristic orientation shown in the views in FIG. 1 can obviously be used alone for erasing purposes. For practical reasons, the strip should, however, be naturally accommodated in some form of housing or holer, a so-called dispenser. Such a dispenser will be exemplified in the following, but it should be appreciated that such outer housings can be designed in a multitude of different ways, and the erasing knife according to the invention is not tied to any special design of this outer housing.

An example of a simple and well-adapted dispenser for the knife according to the invention is accordingly shown in FIG. 3, which is a perspective view of the dispenser, while FIG. 6 shows different projections of it, designated in its entirety by the numeral 50. It consists generally of a housing or magazine 52 with an extending, curved support arm 54 having an L-shape in cross-section and whose outer end forms a substantially flat thumb grip 56. A coil 14 of an erasing strip according to the above is accommodated in the magazine 52, a curved tongue 16 of the strip passing out of the magazine adjacent the inside faces of the arm 54 and terminating in an end piece 38, active for erasure, this end piece engaging against the inside of the thumb grip 56, see FIG. 6*c*. The end piece 38 is kept against the thumb grip 56, and the strip running out of the magazine 52 is fixed in position with the help of a fin or rib 70 in a way which will be described in detail below.

As is apparent from FIGS. 3 and 6, the thumb grip 56 exposes the tip 44 of the strip, as well as the lower portion of the end piece 38 about the active edge 40, and thus, if the outer end of the support arm 54 having the grip 56 is taken between the thumb and forefinger, erasure can be conveniently carried out as illustrated in FIG. 4; only the active edge 40 of the strip coming into contact with the paper, while the remaining portion of the erasing knife with its magazine 52 extends in a characteristic way obliquely upward from the plane of the paper, as shown in FIG. 4. On the other hand, in a position of rest as shown in FIG. 3 the magazine 52 will rest on the substructure while the support arm 54 with the thumb grip 56 will be somewhat uplifte,d, which means that the active edge 40 is protected against unnecessary contact with the substructure. It may be added that although FIG. 4 shows how the erasing knife/dispenser according to the invention is manipulated by a right-handed person, it can be used just as easily by someone who is left-handed.

It is expedient to furnish the magazine 52 with a small slit 90 in its bottom portion 80, see FIG. 5, through which broken-off, used end pieces 38' of the strip 30, broken off according to FIG. 2, can be inserted into the interior of the housing, for rendering them safe in this way. Said bottom portion 80 forms a lid of the magazine 52, see below.

In FIGS. 7–9 there are shown different projections of the three components of which the "erasing dispenser" 50 according to FIGS. 3–6 is composed. The main part of the dispenser is thus shown in FIG. 7, and consists of a casing 60 including said magazine 52 and L-shaped arm 54 extending therefrom, terminated by the flat thumb grip 56. As will be seen, the height of the thumb grip is higher than the rest of the arm. The arm 54 starts out from a cylindrical portion 64 of the casing 60 component of the magazine 52, which thus accommodates the coil portion of the strip 30. As mentioned, after exitting from the magazine the strip extends in an even curve along the inside of the arm 54 and out towards the thumb grip 56 which is provided with a guiding ledge 68, supporting the end piece 38 of the strip, see FIGS. 7*c* and 6*c*.

The second component of the dispenser 50 consists of the previously mentioned lid 80, the bottom part of the magazine 52 and more closely shown in FIG. 9. it has the shape of a flat, circular plate, and when assembling the dispenser, this plate 80 is snapped into the opening of the cylindrical portion 64 of the casing 60, the edge of this cylindrical portion being provided with a shoulder portion 64', see FIG. 7*b*, arranged to accommodate the plate with snap action. As described previously, the plate is also provided with the slit 90.

The third component consists of the above-mentioned fin or rib 70, see FIG. 8. This actually forms a side wall to the casing 60 and is removable, while being lightly spring-biassed between a lug 62 on the cylindrical part 64 of the casing (see FIG. 6*b*, for example) and the arm 54. At one end the fin 70 is formed with a stub 72, accommodated in an opening 66 (see FIG. 7*c*, for example) in the arm 54. At its other end, the fin has a bevelled or thinned-off upper corner portion 74 which is arranged to be thrust up under a flap 63 at the upper end of the lug 62, see FIG. 6*b*.

As will be appreciated from the stated conditions, the stub 72 of the fin 70 also extends through one of the perforations or holes 35 of the erasing strip 30, dimensioning being such that the free end 42 of the strip, formed by the strip having been broken off at one of the openings 35, comes along the outer inclined edge of the thumb grip 56, shown particularly in FIG. 6*c*.

When a new, active piece 38 of the erasing strip 30 is to be moved forward into position inside the thumb grip 56, the fin 70 serves as operating means. The fin is hereby first released by its end engaging with the lug 62 and the flap 63 being moved downwardly-outwardly (see FIG. 6*b*), its sub 72 being then pulled out of the coinciding holes 35 and 66 of the strip and arm, respectively. The stub is then inserted in the next hole 35 along the strip, see FIG. 6*c*, and the strip can thus be moved forward a distance with the help of the fin, until the stub once again glides into the opening 66 in the arm 54. The initial situation is hereby recreated, with the difference that the used end piece 38' of the strip 30 now projects outside the thumb grip 56 and can be broken off, as indicated above, the broken-off bit can be safely disposed of by putting it into the interior of the cylindrical portion 64 of the casing 60 through the slit 90 in the lid or bottom plate 80.

In FIG. 10 there is shown a modified embodiment 57 of the thumb grip pertaining to the support arm 55. As can be seen, in this case the thumb grip 57 is provided at its outer end with a small projection 58, extending downwardly a distance on the inside of the end piece 38 of the strip, the structure preferably being such that the projection 58 is resilient against and exercises a certain pressure against the strip end, for the purpose of further fixing and stabilizing the strip.

The dispenser 50, which thus consists of light plastic pieces, is intended to be thrown away once its erasing strip 30 has been used up, together with its content of pieces 38', which have been broken off one by one from the strip. It is once again emphasized, however, that with regard to the outer housing of the erasing strip is arranged according to FIG. 1, there are several design possibilities open. For example, the erasing strip can be supplied in a small receptacle or box, which is put into a more expensive holder, outwardly resembling the dispenser according to FIG. 3, although not intended to be thrown away but to be recharged with new boxes of strip. Instead, it will be the boxes which are progressively filled with broken-off bits of strip to be finally thrown away when the strip has been used up.

Even if the details described above constitute simple elements for keeping together the dispenser components and for advancing the erasing strip, they can be replaced by other means which are just as simple. For example, the dispenser can be provided with two arms projecting from the magazine 52, these arms being spring-biassed towards each other and between them accommodating the tongue of erasing strip coming from the magazine, the tongue thus being gripped between two jaws, in a manner of speaking, the outer ends of which form coacting grippers for relating the active end piece of the strip between them during erasure. Furthermore, advancing the strip can be arranged with the help of a slide which is mounted in grooves in the arm, or arms of the dispenser and is arranged to engage with the holes 35 in the strip.

One skilled in the art ought to be able to propose other constructive variations of the casing design, and the invention is naturally not confined to the embodiments exemplified above, but it embraces all the other embodiments within the scope of the following claims.

I claim:

1. An erasing knife having a substantially straight knife edge (18, 20) intended for erasing by scraping or cutting, accommodated in a holder means (a so-called dispenser) suitable for its manipulation, characterized by a thin metal strip (10, FIG. 1), preferably of hardened carbon steel, which is ground sharp along at least one edge (12) and at least in part formed to a uniformly bent tongue (16) terminating in a substantially flat end piece (18) with its sharp edge (20) forming an active erasing edge of the erasing knife, the end piece (18) of the knife being kept slightly twisted by the dispenser (50) in relation to the tongue portion of the strip, so that said flat end piece forms a predetermined, acute angel ($\alpha$) with a normal to a plane coinciding with the sharp edge (12) of said tongue portion (16).

2. An erasing knife as claimed in claim 1, characterized in that said tongue (16) is formed by an end portion of a longer strip collected in a substantially cylindrical coil (14) whose geometric axis (15) forms with the plane of the end piece (18) substantially the same acute angle ($\alpha$) as that which said plane forms with said normal.

3. An erasing knife as claimed in claim 2, characterized in that the strip is provided with weakened zones so that the whole or a portion of the end piece can be successively broken off from the strip at definite places, said weak zones being provided at an even pitch (d) along the strip.

4. An erasing knife as claimed in claim 3, characterized in that said weak zones of the strip (30, FIG. 2) are in the form of apertures (35) having at least one straight side which constitutes a part of the free end (42) of the end piece (38) subsequent to the end piece (38') in front, or a portion thereof, having been broken off, this straight side forming an acute angle ($\beta$) with a normal to the edge (40) along the end piece (38).

5. An erasing knife as claimed in claim 4, characterized in that the strip (30) has a width of about 8–10 mm, a thickness of about 0.10–0.12 mm and whose tongue extends from a coil having an outer diameter of about 25–30 mm, the axis of which forms an angle ($\alpha$) of about 20° with the flat end piece (38) of the strip, while the apertures (35) in the strip (30) have the shape of equilateral triangles which (i) are arranged with a pitch (d) of about 8–12 mm; (ii) have such a size that a circle with a diameter of at least 2.5 mm can be inscribed therein; and (iii) have such orientation in relation to the longitudinal direction of the strip that the triangle side, constituting a part of the free end (42) of the new end piece (38) when an end piece (38') is broken off, forms an angle ($\beta$) of about 15° to a normal to the edge (40) along the end piece.

6. An erasing knife as claimed in claim 4, in which the dispenser (50) comprises a magazine (52) accommodating the coil (14) of strip, said magazine consisting of a cylindrical box-like casing (60) closed by a bottom part (80), characterized by a support arm (54) projecting from the magazine (52), the tongue (16) coming from the coil (14) extending along said arm (54), the outer end of which is extended in height to form a substantially flat portion (56) arranged to make contact with the flat end piece (38) of the strip, said piece together with the support portion (56) being arranged for gripping by the fingers of a user for carrying out an erasing operation.

7. An erasing knife as claimed in claim 6, characterized in that said bottom part (80) is provided with a slot (90) through which broken-off used end pieces (38') of the strip can be inserted into the interior of the magazine (52).

8. An erasing knife as claimed in claim 7, characterized by a removable retainer means in the form of a fin or the like (70), one end of which is made with a guiding stub (72) arranged for introducing into one of the apertures (35) in the strip (30) and through an opening (66) in the holder arm (54) in such a way that the end of the fin (70) about the guiding stub keeps the strip against the arm, the fin being arranged so that after loosening it can be used for advancing the strip (30) by having its guiding stub (72) inserted in a strip aperture (35) closer to the magazine (52) whereupon the fin is actuated to push or pull the strip forward one pitch.

9. An erasing knife as claimed in claim 8, characterized in that the end of the fin (70) remote from the stub (72) is arranged for accommodation in a seating (62, 63) formed in a portion of the casing (60) lying substantially opposite said opening (66).

10. An erasing knife as claimed in claim 6, characterized in that the support arm is provided with an actuator in the form of a slide or the like, glidably accommodated in a guiding groove in the arm and arranged for engaging in one of the apertures of the strip for advancing it.

* * * * *